US010969142B2

(12) United States Patent
Tsuda et al.

(10) Patent No.: US 10,969,142 B2
(45) Date of Patent: Apr. 6, 2021

(54) HEATING AND HOT WATER SUPPLY APPARATUS AND METHOD OF CONTROLLING THE SAME

(71) Applicant: NORITZ CORPORATION, Hyogo (JP)

(72) Inventors: Naoki Tsuda, Hyogo (JP); Yoshifumi Atobe, Hyogo (JP); Kenichi Nakayama, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 340 days.

(21) Appl. No.: 16/033,232

(22) Filed: Jul. 12, 2018

(65) Prior Publication Data

US 2019/0032960 A1 Jan. 31, 2019

(30) Foreign Application Priority Data

Jul. 27, 2017 (JP) ..... JP2017-145419

(51) Int. Cl.

| | |
|---|---|
| ***F24H 9/20*** | (2006.01) |
| ***F24H 1/14*** | (2006.01) |
| ***F24H 9/18*** | (2006.01) |
| ***F24H 9/12*** | (2006.01) |
| ***F24H 8/00*** | (2006.01) |

(Continued)

(52) U.S. Cl.

CPC ..... *F24H 9/2035* (2013.01); *F24D 19/1066* (2013.01); *F24H 1/145* (2013.01); *F24H 1/52* (2013.01); *F24H 8/006* (2013.01); *F24H 9/128* (2013.01); *F24H 9/1836* (2013.01)

(58) Field of Classification Search

CPC ..... F24H 9/2035

See application file for complete search history.

(56) References Cited

U.S. PATENT DOCUMENTS

2011/0017152 A1* 1/2011 Min ..... F24D 19/1066 122/19.1

2015/0300661 A1* 10/2015 Park ..... F24H 1/52 237/8 R (Continued)

FOREIGN PATENT DOCUMENTS

JP 2005337632 A * 12/2005

JP 2011515647 5/2011

*Primary Examiner* — Nathaniel Herzfeld

(74) *Attorney, Agent, or Firm* — JCIPRNET

(57) ABSTRACT

In a heating and hot water supply apparatus, a heat exchanger for hot water supply includes a primary-side path and a secondary-side path. A bypass path branches from a heating circulation path and is configured such that a heat transfer medium heated by a heating device flows through the primary-side path without passing through a heating terminal when hot water supply operation is performed and then joins the heating circulation path again. A control unit controls a flow rate regulating valve so that a hot water flow rate does not exceed a reference limit flow rate when hot water supply operation is performed. The reference limit flow rate is set on the basis of the smaller one between a maximum heating capacity of the heating device and a heating capacity of the heating device at which an output temperature of the heated heat transfer medium reaches an upper limit temperature.

14 Claims, 7 Drawing Sheets

(51) Int. Cl.
*F24D 19/10* (2006.01)
*F24H 1/52* (2006.01)

(56) References Cited

U.S. PATENT DOCUMENTS

2017/0059205 A1* 3/2017 Kim ..... F24H 8/00
2017/0363301 A1* 12/2017 Son ..... F24D 19/1051

* cited by examiner

HEATING AND HOT WATER SUPPLY APPARATUS AND METHOD OF CONTROLLING THE SAME

CROSS-REFERENCE TO RELATED APPLICATION

This application claims the priority benefit of Japan application serial no. 2017-145419, filed on Jul. 27, 2017. The entirety of the above-mentioned patent application is hereby incorporated by reference herein and made a part of this specification.

BACKGROUND

Technical Field

The present disclosure relates to a heating and hot water supply apparatus and a method of controlling the same, and more specifically, to a heating and hot water supply apparatus having a heating function and a hot water supply function and a method of controlling the same.

Description of Related Art

As an aspect of a heating and hot water supply apparatus, as described in, for example, Published Japanese Translation No. 2011-515647 of the PCT International Publication (Patent Document 1), a configuration having a heating function by causing a heat transfer medium to flow through a circulation path formed to and from a heating terminal and a hot water supply function due to a bypass path including a heat exchanger for hot water supply branching from the circulation path is known.

In the heating and hot water supply apparatus described above, low temperature water introduced into a secondary-side path of the heat exchanger for hot water supply is heated by a liquid-phase heat transfer medium that is heated by a heating device and then flows through the primary-side path of the heat exchanger for hot water supply, and thus the hot water supply function can be realized.

[Patent Document 1] Published Japanese Translation No. 2011-515647 of the PCT International Publication In the heating and hot water supply apparatus described above, generally, when a heating capacity required for a hot water supply operation exceeds a maximum heating capacity of the heating device, for example, when a temperature of low temperature water introduced into a secondary-side path of the heat exchanger for hot water supply is low, a hot water flow rate is limited in order to discharge hot water according to a hot water supply set temperature.

On the other hand, when the low-temperature water temperature is high, a temperature required for the temperature of the heat transfer medium introduced into the primary-side path of the heat exchanger for hot water supply (that is, an output temperature of the heat transfer medium after it is heated by the heating device) is also higher. In addition, the heat exchange efficiency in the heat exchanger for hot water supply is low. Therefore, the output temperature of the heat transfer medium in the heating device is likely to increase. When the output temperature of the heat transfer medium increases, there is a risk of the heating device being damaged due to overheating and a boiling sound being generated inside a heat transfer pipe of the heat exchanger.

When an amount of heat generated in the heating device is reduced, it is possible to protect the heating device. On the other hand, a heating capacity of the heating device becomes insufficient and thus the hot water temperature is lowered. As a result, there is a concern of discharging of hot water according to the hot water supply set temperature being difficult.

SUMMARY

The present disclosure is able to discharge as much hot water as possible according to a hot water supply set temperature while a heating device is protected during a hot water supply operation of a heating and hot water supply apparatus having a heating function and a hot water supply function.

According to an aspect of the present disclosure, a heating and hot water supply apparatus includes a heating device configured to heat a heat transfer medium; a heating circulation path for circulating the heat transfer medium heated by the heating device when a heating operation is performed to and from the heating terminal; a heat exchanger for hot water supply including a primary-side path and a secondary-side path for heat exchange between liquids; a bypass path which branches from the heating circulation path and through which the heat transfer medium flows through the primary-side path of the heat exchanger for hot water supply without passing through the heating terminal when a hot water supply operation is performed and then joins the heating circulation path again; a water inlet pipe that is connected to an input side of the secondary-side path; a hot water delivery pipe that is connected to an output side of the secondary-side path; a flow rate regulating valve configured to control a hot water flow rate of the hot water delivery pipe; and a control unit configured to control the flow rate regulating valve so that the hot water flow rate does not exceed a reference limit flow rate when the hot water supply operation is performed. The reference limit flow rate is set on the basis of the smaller one between a maximum heating capacity of the heating device and a heating capacity of the heating device at which an output temperature of the heated heat transfer medium reaches an upper limit temperature.

According to another aspect of the present disclosure, there is provided a method of controlling a heating and hot water supply apparatus including a heating device configured to heat a heat transfer medium; a heating circulation path for circulating the heat transfer medium heated by the heating device when a heating operation is performed to and from the heating terminal; a heat exchanger for hot water supply including a primary-side path and a secondary-side path for heat exchange between liquids; a bypass path which branches from the heating circulation path and through which the heat transfer medium flows through the primary-side path of the heat exchanger for hot water supply without passing through the heating terminal and then joins the heating circulation path again; a water inlet pipe that is connected to an input side of the secondary-side path; a hot water delivery pipe that is connected to an output side of the secondary-side path; and a flow rate regulating valve configured to control a hot water flow rate of the hot water delivery pipe. The control method includes a step of setting a first limit flow rate on the basis of a maximum hot water supply capacity of the heating device; a step of setting a second limit flow rate on the basis of a heating capacity of the heating device at which an output temperature of the heated heat transfer medium reaches an upper limit temperature; and a step of setting the smaller one between the first limit flow rate and the second limit flow rate as a reference limit flow rate and controlling the flow rate regulating valve so that the hot water flow rate does not exceed the reference limit flow rate.

DESCRIPTION OF THE EMBODIMENTS

Figure 1:
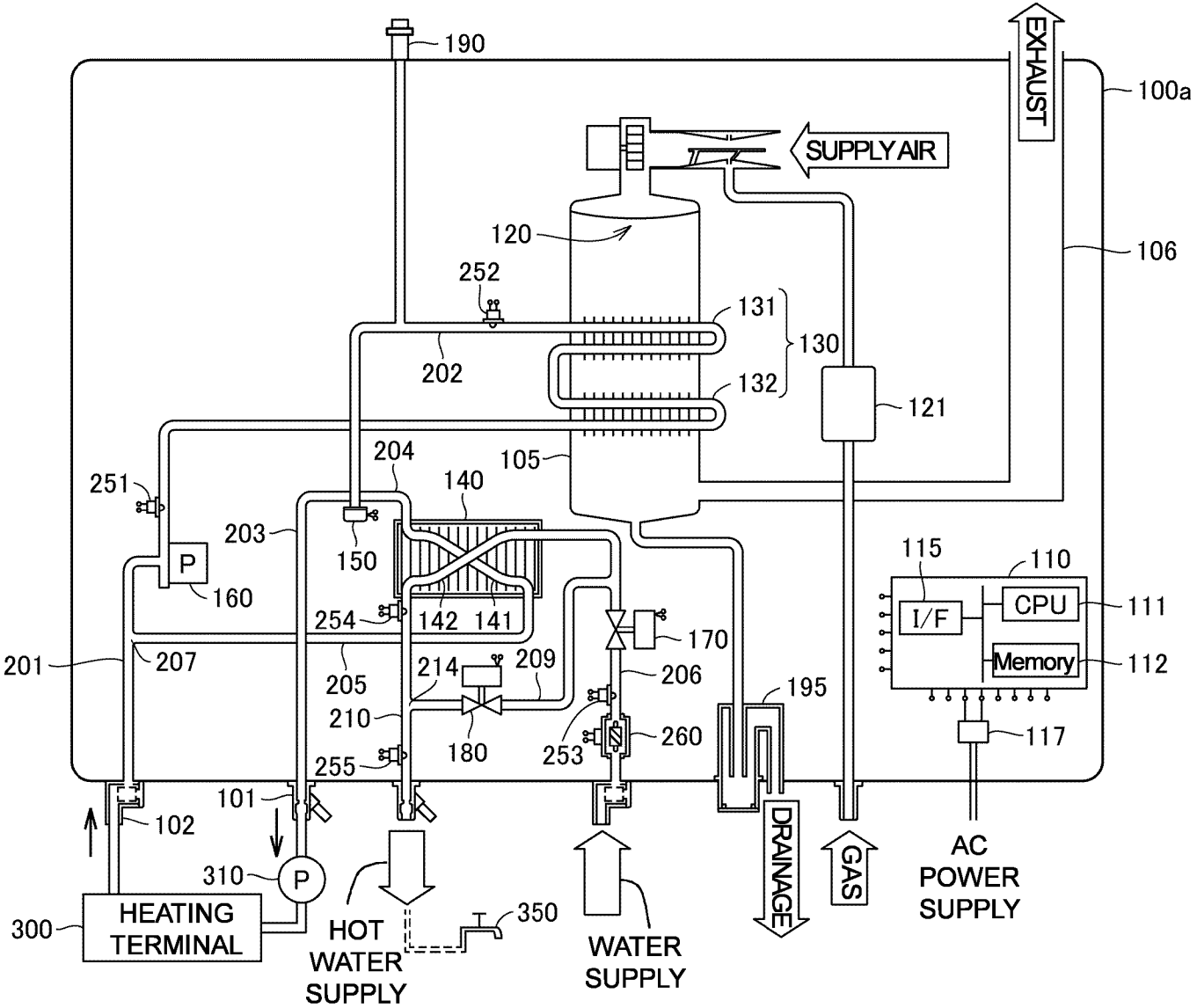
FIG. 1 is an operation principle diagram explaining a configuration of a heating and hot water supply apparatus according to Embodiment 1.

Embodiments of the present disclosure will be described below in detail with reference to the drawings. Here, the same or corresponding components in the drawings will be denoted with the same reference numerals and descriptions thereof will not be repeated in principle.

Embodiment 1

FIG. 1 is an operation principle diagram explaining a configuration of a heating and hot water supply apparatus according to Embodiment 1.

Referring to FIG. 1, a heating and hot water supply apparatus 100*a* according to Embodiment 1 includes an output end 101 and an input end 102 connected to a heating terminal 300, a water inlet pipe 206 into which low temperature water such as tap water is introduced, and a hot water delivery pipe 210 for supplying hot water to a hot water tap 350 or the like. In the heating and hot water supply apparatus 100*a*, a heating function is realized by circulating a heat transfer medium (high temperature water) to the heating terminal 300 via the output end 101 and the input end 102. In addition, when low temperature water introduced into the water inlet pipe 206 is heated according to heat exchange with the heat transfer medium, a function of hot water supply from the hot water delivery pipe 210 is realized.

First, a configuration related to a heating function of the heating and hot water supply apparatus 100*a* will mainly be described. The heating and hot water supply apparatus 100*a* further includes a can body 105 into which a combustion burner 120 and a heat exchanger 130 are built, an exhaust pipe 106, a controller 110, a heat exchanger for hot water supply 140, a distribution valve 150, a circulation pump 160, and pipes 201 to 205.

The combustion burner 120 receives supply of a fuel represented as a gas and generates an amount of heat according to combustion of the fuel. The fuel is supplied to the combustion burner 120 via a flow rate control valve 121. When a rotational speed of a suction type fan is controlled, a degree of opening of the flow rate control valve 121 is regulated and a flow rate of a gas supplied to the combustion burner 120, that is, an amount of heat generated in the combustion burner 120 can be controlled.

The heat exchanger 130 includes a primary heat exchanger 131 for heating a fluid according to mainly sensible heat due to fuel combustion in the combustion burner 120 and a secondary heat exchanger 132 for heating a fluid according to mainly latent heat of an exhaust gas due to fuel combustion.

A combustion exhaust gas generated according to combustion of the combustion burner 120 is discharged outside of the heating and hot water supply apparatus 100*a* via the exhaust pipe 106. In addition, in the secondary heat exchanger 132, acidic water (drainage) generated when combustion exhaust gases are cooled according to heat exchange for latent heat recovery and condense is neutralized by a neutralizing device (not shown) and then collected in a water seal trap 195, and discharged outside of the heating and hot water supply apparatus 100*a*.

The input end 102 into which a heat transfer medium that has flowed through the heating terminal 300 is input is connected to the input side of the secondary heat exchanger 132 via the pipe 201. The output side of the primary heat exchanger 131 is connected to the pipe 202. The pipe 202 is connected to the pipes 203 and 204 via the distribution valve 150. The pipe 203 is connected to the output end 101 for outputting a heat transfer medium to the heating terminal 300. The pipe 204 is connected to the input side of a primary-side path 141 of the heat exchanger for hot water supply 140. The output side of the primary-side path 141 of the heat exchanger for hot water supply 140 is connected to the pipe 201 via the pipe 205.

A degree of opening of the distribution valve 150 is controlled by the controller 110. According to a degree of opening of the distribution valve 150, a ratio between a flow rate for a path from the pipe 202 to the pipe 203 and a flow rate for a path from the pipe 202 to the pipe 204 can be controlled.

The heating terminal 300 and a heating pump 310 are connected between the output end 101 and the input end 102. When the heating pump 310 is operated, inside the heating and hot water supply apparatus 100*a*, a "heating circulation path" for circulating a heat transfer medium to and from the heating terminal 300 is formed between the output end 101 and the input end 102. The heating circulation path includes the pipe 201, the heat exchanger 130, the pipe 202, the distribution valve 150, and the pipe 203. For example, the heat transfer medium may be high temperature water heated according to an amount of heat generated in the combustion burner 120 in the heat exchanger 130. That is, the combustion burner 120 and the heat exchanger 130 (that is, the can body 105) correspond to an example of a "heating device."

When the heat transfer medium is supplied to the heating terminal 300, it is possible to heat a space (indoor) in which the heating terminal 300 is deployed. That is, the heating and hot water supply apparatus 100*a* can realize a heating function by heating a heat transfer medium that flows through the heating circulation path formed by the operation of the heating pump 310.

In the heating circulation path, a pressure relief valve 190 is further provided. In addition, although not shown, a circuit for replenishment with tap water or the like when the amount of heat transfer medium is reduced is additionally connected to the heating circulation path.

When the heat transfer medium is introduced into the pipe 204 by the distribution valve 150, a bypass path branched from the heating circulation path can be formed for the heat transfer medium heated by the heat exchanger 130. The bypass path includes the pipe 204, the primary-side path 141 of the heat exchanger for hot water supply 140, and the pipe 205. The heat transfer medium that flows through the bypass path flows through the heat exchanger for hot water supply 140 (the primary-side path 141) without passing through the heating terminal 300 and then joins the heating circulation path at a connection point 207 between the pipes 201 and 205.

The circulation pump 160 is deployed downstream (side on the heat exchanger 130) from the connection point 207 in the pipe 201. Therefore, when the circulation pump 160 is operated, even if the heating circulation path is not formed by an operation of the heating pump 310, it is possible to form the bypass path for allowing the heat transfer medium to flow through the heat exchanger 130 and the heat exchanger for hot water supply 140.

According to a degree of opening of the distribution valve 150, for the heat transfer medium heated by the heat exchanger 130, it is possible to control a ratio between a supply flow rate for the heating circulation path and a supply flow rate for the bypass path. Hereinafter, a ratio of the flow rate supplied to the bypass path to a total flow rate of the heat transfer medium output from the heat exchanger 130 will be also referred to as a "distribution ratio $\eta 1$." The distribution ratio $\eta 1$ is controlled between $\eta 1=0$ (that is, the entire amount of the heat transfer medium flows through the heating circulation path) and $\eta 1=1.0$ (that is, the entire amount of the heat transfer medium flows through the bypass path) ($0 \leq \eta 1 \leq 1.0$). That is, the distribution valve 150 corresponds to an example of a "flow rate control device."

Next, constituents connected to a secondary-side path 142 of the heat exchanger for hot water supply 140 related to a hot water supply function of the heating and hot water supply apparatus 100*a* will be described.

The heating and hot water supply apparatus 100*a* includes a bypass pipe 209, a flow rate regulating valve 170, and a bypass flow rate valve 180 in addition to the water inlet pipe 206 and the hot water delivery pipe 210.

When the hot water tap 350 is opened, low temperature water is introduced from the water inlet pipe 206 due to a water pressure of tap water or the like. The water inlet pipe 206 is connected to the input side of the secondary-side path 142 of the heat exchanger for hot water supply 140. The hot water delivery pipe 210 is connected to the output side of the secondary-side path 142 of the heat exchanger for hot water supply 140. In the heat exchanger for hot water supply 140, according to an amount of heat of the heat transfer medium that flows through the primary-side path 141, low temperature water that flows through the secondary-side path 142 is heated. As a result, high temperature water is output from the secondary-side path 142 to the hot water delivery pipe 210.

The bypass pipe 209 is provided to form a bypass path of the heat exchanger for hot water supply 140 between the water inlet pipe 206 and the hot water delivery pipe 210. In the hot water delivery pipe 210, a junction 214 with the bypass pipe 209 is provided. Thus, hot water with a suitable temperature in which high temperature water heated by the heat exchanger for hot water supply 140 and low temperature water that has passed through the bypass pipe 209 are mixed is supplied from the hot water delivery pipe 210 to the hot water tap 350 or the like.

The bypass flow rate valve 180 is provided in the bypass pipe 209. According to a degree of opening of the bypass flow rate valve 180, a ratio of a flow rate for the bypass pipe 209 to a flow rate of water input to the water inlet pipe 206, that is, a mixing ratio between high temperature water and low temperature water, is controlled. Hereinafter, a ratio of the flow rate for the bypass pipe 209 to the inlet water flow rate for the water inlet pipe 206 will be also referred to as "distribution ratio $\eta 2$ for hot water supply." The distribution ratio $\eta 2$ for hot water supply is controlled between $\eta 2=\eta close$ (fully closed state, that is, the entire amount of inlet water flows through the secondary-side path 142 of the heat exchanger for hot water supply 140) and $\eta 2=\eta open$ (fully opened state, that is, the entire amount of inlet water flows through the bypass pipe 209) ($\eta close \leq \eta 2\ \eta open$). That is, the bypass flow rate valve 180 corresponds to an example of a "bypass flow rate valve."

The flow rate regulating valve 170 can be deployed in the water inlet pipe 206. For example, during a period in which a heating capacity becomes insufficient immediately after hot water supply is started, when a degree of opening of the flow rate regulating valve 170 is controlled so that a hot water flow rate is reduced, it is possible to prevent the temperature of hot water from decreasing. In addition, also at a time other than immediately after hot water supply is started, in order to supply hot water according to a set hot water supply temperature at the time of a high flow rate, the hot water flow rate can be reduced according to control of a degree of opening of the flow rate regulating valve 170. That is, the flow rate regulating valve 170 corresponds to an example of a "flow rate regulating valve."

In the pipe 201, a temperature sensor 251 for detecting an input temperature $\theta 1$ in of a heat transfer medium in the heat exchanger 130 in the heating circulation path is provided. In the pipe 202, a temperature sensor 252 for detecting an output temperature $\theta 1$ of the heat transfer medium heated by the heat exchanger 130 is deployed.

In addition, a temperature sensor 253 for detecting a temperature $\theta in$ of low temperature water introduced into the water inlet pipe 206 related to the hot water supply function is provided. A temperature sensor 254 for detecting a temperature $\theta 2$ of high temperature water is deployed on the output side of the secondary-side path 142 of the heat exchanger for hot water supply 140. In addition, downstream from the junction 214 of the hot water delivery pipe 210, a temperature sensor 255 for detecting a temperature $\theta out$ of hot water after high temperature water and low temperature water are mixed is deployed. The temperature sensor 253 corresponds to an example of a "first temperature sensor," and the temperature sensor 251 corresponds to an example of a "second temperature sensor." In addition, the temperature sensor 255 corresponds to an example of a "third temperature sensor" and the temperature sensor 254 corresponds to an example of a "fourth temperature sensor."

The controller 110 operates by receiving supply of a power supply voltage (for example, DC 15 V) from a power supply circuit 117. The power supply circuit 117 converts power from an external power supply (for example, commercial AC power source) of the heating and hot water supply apparatus 100*a* into a power supply voltage.

The controller 110 includes a central processing unit (CPU) 111, a memory 112, and an interface (I/F) 115. The controller 110 executes a program that is stored in the memory 112 in advance, and controls operations of components so that the heating and hot water supply apparatus 100*a* is operated according to a user operation command.

Figure 2:
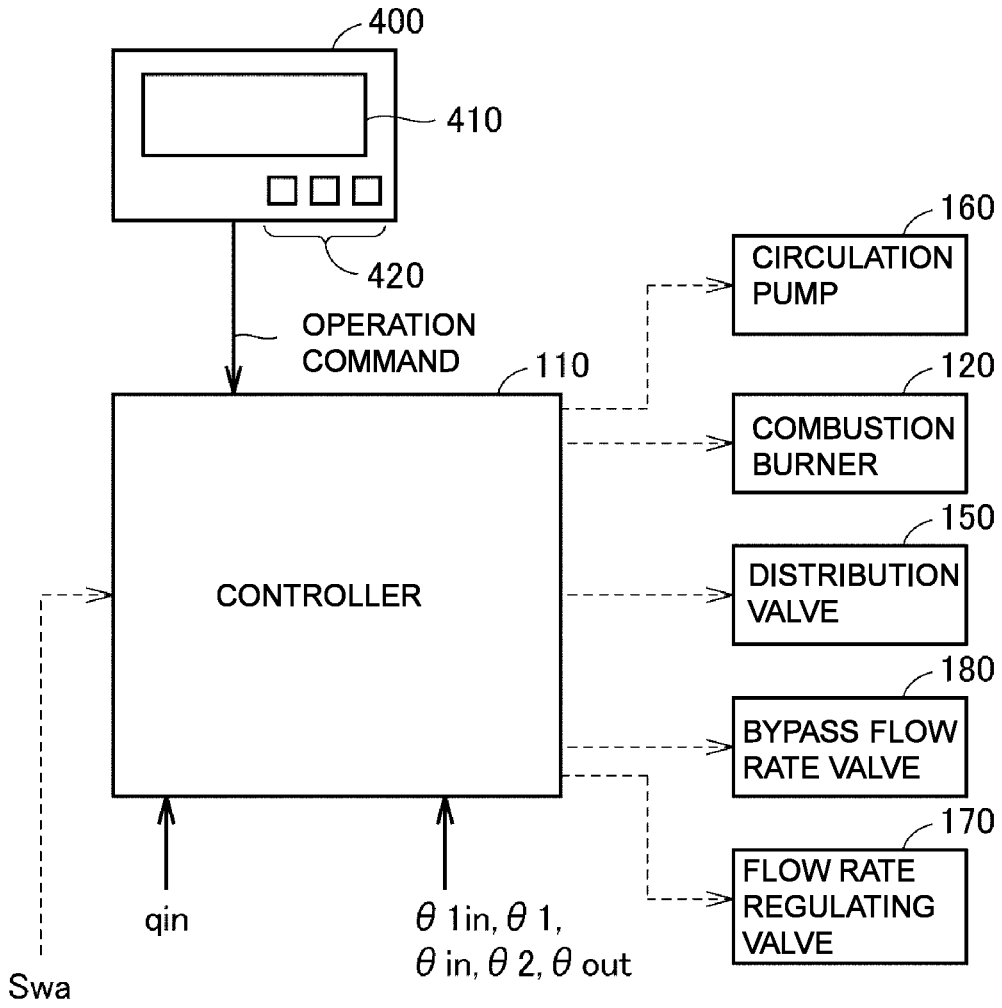
FIG. 2 is a functional block diagram explaining operation control of a heating and hot water supply apparatus by a controller.

FIG. 2 shows a functional block diagram explaining operation control of the heating and hot water supply apparatus 100*a* by the controller 110.

Referring to FIG. 2, the controller 110 is connected to a remote controller (hereinafter simply referred to as a "remote controller") 400 of the heating and hot water supply apparatus 100*a* via a communication line (for example, a 2-core communication line). Bidirectional communication is possible between the remote controller 400 and the controller 110.

In the remote controller 400, a display unit 410 and an operation unit 420 are provided. The user can input an operation command of the heating and hot water supply apparatus 100*a* using the operation unit 420. The operation command includes an operation on and off command of the heating and hot water supply apparatus 100*a*, a hot water supply set temperature in the hot water supply operation, and a heating capacity in the heating operation. The display unit 410 can be formed of a liquid crystal panel. The display unit 410 can visually display an operation state of the heating and hot water supply apparatus 100*a* and information indicating details of the set operation command. Alternatively, a part of the whole of the operation unit 420 can be formed using a partial area of the display unit 410 formed of a touch panel.

The operation command input to the remote controller 400 is input to the controller 110. In addition, the input temperature θ1 in and the output temperature θ1 of the heat transfer medium detected by the temperature sensors 251 to 255 and a low-temperature water temperature θin, a high-temperature water temperature θ2, and a hot water temperature θout are input. In addition, a flow rate detection value qin by a flow rate sensor 260 is input to the controller 110. In addition, a signal Swa from the side of the heating terminal 300 can be input to the controller 110. For example, the signal Swa includes a signal indicating operation/stopping of the heating pump 310.

The controller 110 outputs a signal for controlling operation or stopping of the circulation pump 160, a signal for controlling a degree of opening of the distribution valve 150, a signal for controlling a degree of opening of the bypass flow rate valve 180, a signal for controlling a degree of opening of the flow rate regulating valve 170, and a signal for controlling an amount of heat generated in the combustion burner 120 (for example, a rotational speed control signal of a suction type fan) so that the heating and hot water supply apparatus 100*a* is operated according to the operation command. These signals are output from the controller 110 through the interface 115 according to control processing results in the CPU 111. The controller 110 corresponds to an example of a "control unit."

Figure 3:
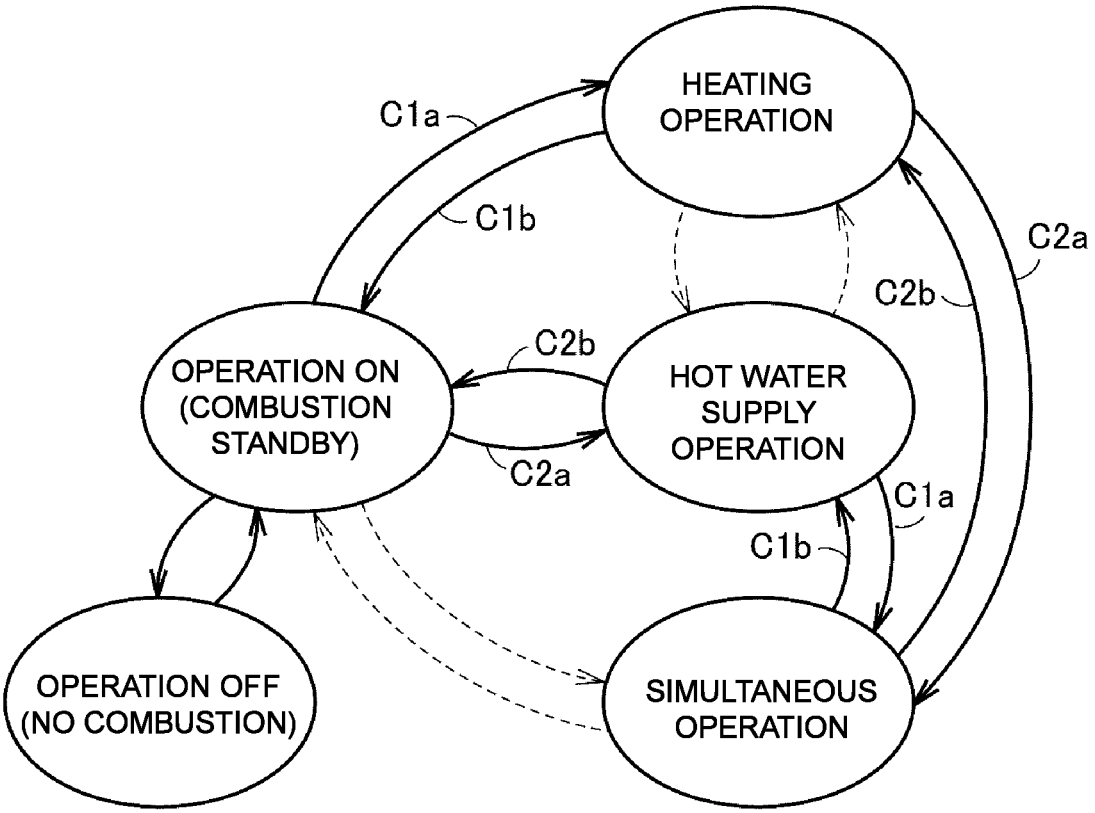
FIG. 3 is a transition diagram of operation states of the heating and hot water supply apparatus shown in FIG. 1.

FIG. 3 shows a transition diagram of operation states of the heating and hot water supply apparatus 100*a* shown in FIG. 1.

Referring to FIG. 3, when an operation switch of the heating and hot water supply apparatus 100*a* is turned on by the remote controller 400, the heating and hot water supply apparatus 100*a* transitions from an operation off state to an operation on state. In the operation on state, the heating and hot water supply apparatus 100*a* is in a state in which the heating operation can be performed and components are in a state in which an operation can be performed. Combustion in the combustion burner 120 comes into a standby state.

In the operation on state, when the heating circulation path described in FIG. 1 is formed by the operation of the heating pump 310, an on condition C1*a* of the heating operation is satisfied, and the heating and hot water supply apparatus 100*a* performs a heating operation of supplying a heat transfer medium to the heating terminal 300.

In the heating operation, when the combustion burner 120 is operated while the heating circulation path is formed, the heat transfer medium that flows through the heat exchanger 130 is heated. Here, the heating circulation path that is formed can be detected on the basis of the signal Swa input by the controller 110.

When the combustion burner 120 is operated, an amount of heat generated in the combustion burner 120 is regulated so that the output temperature θ1 of the heat transfer medium is controlled such that it becomes a target temperature value during the heating operation. During the heating operation, the target temperature value of the heat transfer medium can be set according to a set heating temperature in the heating terminal 300.

Here, in the heating operation, since hot water supply from the hot water delivery pipe 210 is unnecessary, the heat exchanger for hot water supply 140, that is, supply of the heat transfer medium to the bypass path is unnecessary. Therefore, a degree of opening of the distribution valve 150 is controlled so that the distribution ratio becomes 0 (η1=0) and thereby the entire amount of the heat transfer medium heated by the heat exchanger 130 flows the heating circulation path.

During the heating operation, when the heating pump 310 is stopped, an off condition C1*b* of the heating operation is satisfied, and the heating and hot water supply apparatus 100*a* returns to an operation on state. Thereby, the combustion burner 120 is stopped.

On the other hand, in the operation on state, when the hot water tap 350 is opened, low temperature water is supplied to the water inlet pipe 206 due to a water pressure of tap water. Therefore, when a flow rate detection value qin of the flow rate sensor 260 exceeds a predetermined minimum flow rate, an on condition C2*a* of the hot water supply operation is satisfied, and the heating and hot water supply apparatus 100*a* performs the hot water supply operation of heating low temperature water by the heat exchanger for hot water supply 140.

In the hot water supply operation, since supply of the heat transfer medium to the heating terminal 300 is unnecessary, supply of the heat transfer medium to the heating circulation path is unnecessary. Therefore, a degree of opening of the distribution valve 150 is controlled so that the distribution ratio becomes 1.0 (η1=1.0) and thereby the entire amount of the heat transfer medium heated by the heat exchanger 130 flows the bypass path.

In the hot water supply operation, even if the heating pump 310 is stopped, when the circulation pump 160 is operated, it is possible to form the bypass path of the heat transfer medium. Accordingly, it is possible to flow the heat transfer medium heated by the heat exchanger 130 through the primary-side path 141 of the heat exchanger for hot water supply 140.

Therefore, when low temperature water introduced into the secondary-side path 142 of the heat exchanger for hot water supply 140 from the water inlet pipe 206 is heated, it is possible to supply hot water from the hot water delivery pipe 210 to the hot water tap 350. In the hot water supply operation, a mixing ratio between low temperature water and high temperature water is controlled according to a degree of opening of the bypass flow rate valve 180 so that the hot water temperature θout (a temperature detected by the temperature sensor 255) matches a hot water supply set temperature θsv input to the remote controller 400.

During the hot water supply operation, when the hot water tap 350 is closed and thus the flow rate detection value qin of the flow rate sensor 260 is smaller than a minimum flow rate, an off condition C2*b* of the hot water supply operation is satisfied, and thus the heating and hot water supply apparatus 100*a* returns to an operation on state. Therefore, the combustion burner 120 is stopped.

When the on condition C2*a* of the hot water supply operation is additionally satisfied during the heating operation, or when the on condition C1*a* of the heating operation is additionally satisfied during the hot water supply operation, the heating and hot water supply apparatus 100*a* performs the simultaneous operation of hot water supply and heating.

During the simultaneous operation, it is necessary to flow the heat transfer medium through both the heating circulation path and the bypass path. Therefore, a degree of opening of the distribution valve 150 is set to a predetermined ratio $\eta 1$. Since $0<\eta 1<1.0$ is satisfied, the heat transfer medium heated by the heat exchanger 130 is distributed to both the heating circulation path (the pipe 203) and the bypass path (the pipe 204). Therefore, when the heat transfer medium flows through the heating circulation path, the heat transfer medium is supplied to the heating terminal 300, and the heat transfer medium is also supplied to the primary-side path 141 of the heat exchanger for hot water supply 140. Also in the simultaneous operation, the hot water temperature θout is controlled by the bypass flow rate valve 180 in the same manner as in the hot water supply operation.

During the simultaneous operation, when the off condition C1*b* of the heating operation is satisfied, the heating and hot water supply apparatus 100*a* transitions to the hot water supply operation. In addition, during the simultaneous operation, when the off condition C2*b* of the hot water supply operation is satisfied, the heating and hot water supply apparatus 100*a* transitions to the heating operation. In addition, during the simultaneous operation, when the off condition C1*b* of the heating operation and the off condition C2*b* of the hot water supply operation are simultaneously satisfied, the heating and hot water supply apparatus 100*a* returns to the operation on state, and the combustion burner 120 is stopped. On the other hand, in the operation on state, when the on condition C1*a* of the heating operation and the on condition C2*a* of the hot water supply operation are simultaneously satisfied, the heating and hot water supply apparatus 100*a* can directly transition to the simultaneous operation.

Alternatively, during the hot water supply operation, when the on condition C1*a* of the heating operation and the off condition C2*b* of the hot water supply operation are simultaneously satisfied, the heating and hot water supply apparatus 100*a* can directly transition to the heating operation. On the other hand, during the heating operation, when the on condition C2*a* of the hot water supply operation and the off condition C1*b* of the heating operation are simultaneously satisfied, the heating and hot water supply apparatus 100*a* can directly transition to the hot water supply operation.

Here, when the operation switch is operated during the heating operation, during the hot water supply operation, or during the simultaneous operation, the heating and hot water supply apparatus 100*a* stops the combustion burner 120 and directly transitions to the operation off state. In the operation on state, even if the operation switch is operated, the heating and hot water supply apparatus 100*a* returns to the operation off state.

In addition, the heating and hot water supply apparatus 100*a* according to the present embodiment has a function of limiting a hot water flow rate in the hot water delivery pipe 210 in order to discharge hot water according to the hot water supply set temperature θsv when the hot water supply operation is performed.

Figure 4:
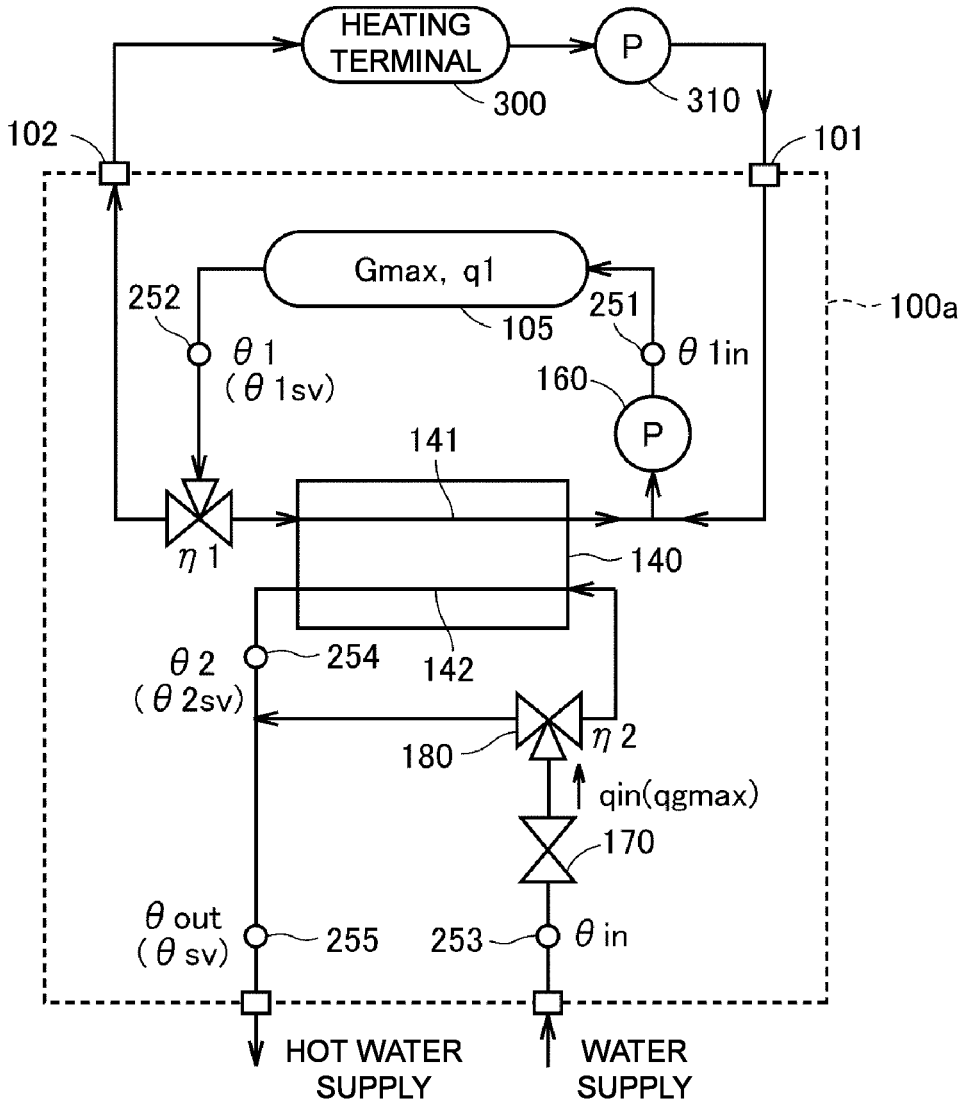
FIG. 4 is a diagram explaining control for limiting a hot water flow rate during a hot water supply operation in the heating and hot water supply apparatus according to Embodiment 1.
Figure 5:
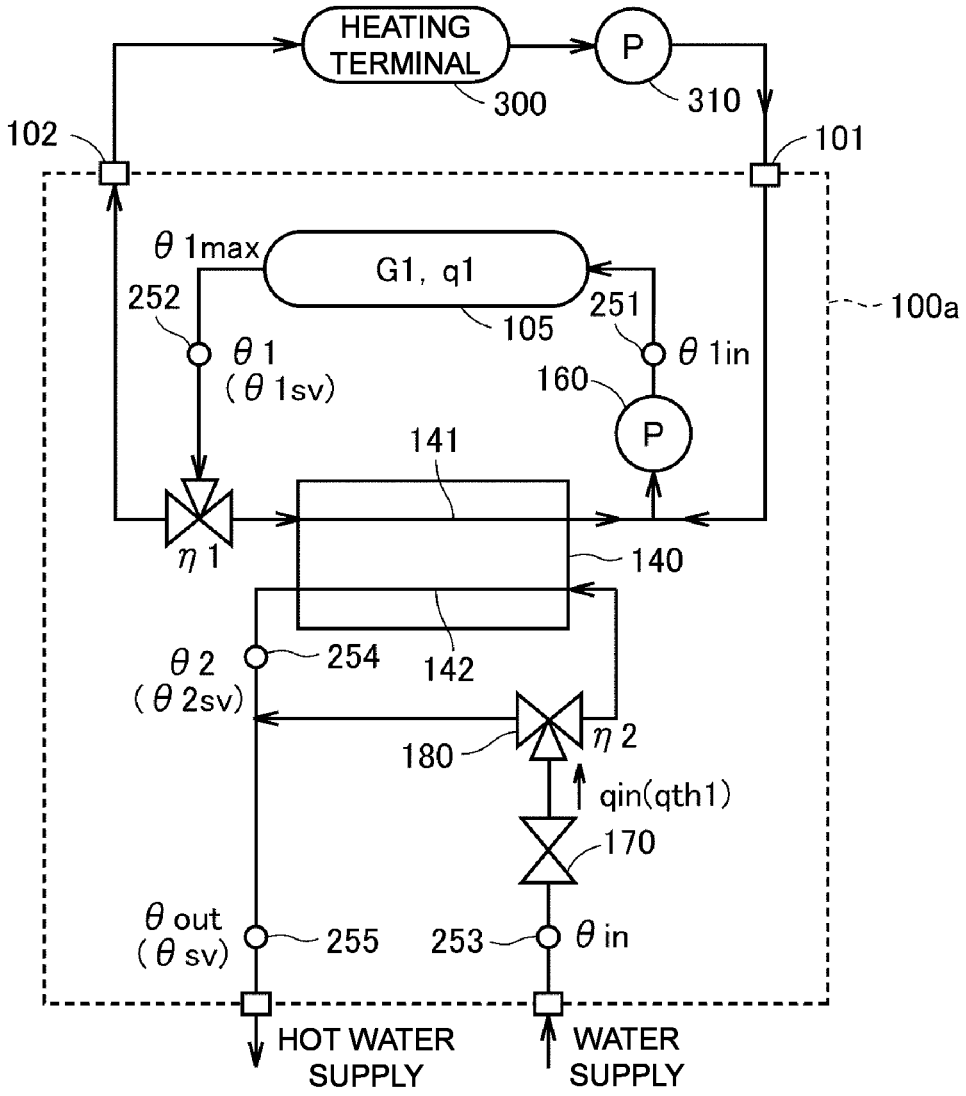
FIG. 5 is a diagram explaining control for limiting a hot water flow rate during a hot water supply operation in the heating and hot water supply apparatus according to Embodiment 1.

FIG. 4 and FIG. 5 are diagrams explaining control for limiting a hot water flow rate during the hot water supply operation in the heating and hot water supply apparatus 100*a* according to Embodiment 1. In FIG. 4 and FIG. 5, a configuration related to the hot water supply function of the heating and hot water supply apparatus 100*a* shown in FIG. 1 is extracted and shown.

As described with FIG. 3, when the operation switch is turned on, the hot water supply operation is started according to a flow rate qin of the water inlet pipe 206. However, an amount of heat received Qr in the heat exchanger for hot water supply 140 which is necessary for setting the hot water temperature θout to the hot water supply set temperature θsv may exceed an amount of heat supplied Qs in the heat exchanger for hot water supply 140. In such a case, there is a concern of the hot water temperature θout being lower than the hot water supply set temperature θsv.

Specifically, an amount of heat received Qr in the heat exchanger for hot water supply 140 which is necessary for setting the hot water temperature θout to the hot water supply set temperature θsv is calculated by a product of a temperature raising amount Δθ which is a temperature difference (θset−θin) between the hot water supply set temperature θsv and the low-temperature water temperature θin, and the flow rate detection value qin. Generally, the amount of heat received Qr is indicated by a number unit. Here, the number =1 (No. 1) corresponds to an amount of heat necessary to raise qin=1 [L/min] to 25° C.

On the other hand, an amount of heat supplied Qs in the heat exchanger for hot water supply 140 is determined by a heating capacity in the heating device (the combustion burner 120 and the heat exchanger 130 built into the can body 105). When the hot water supply operation is performed, all of the maximum heating capacity (maximum number) Gmax of the heating device can be used in the hot water supply operation.

However, when the low-temperature water temperature θin is lower and the temperature raising amount Δθ is larger, or when the flow rate detection value qin is larger, an amount of heat received Qr in the heat exchanger for hot water supply 140 is larger. Therefore, when an amount of heat received Qr in the heat exchanger for hot water supply 140 exceeds an amount of heat supplied Qs in the maximum heating capacity Gmax of the heating device, there is a concern of the hot water temperature θout being lower than the hot water supply set temperature θsv.

In order to reduce such a decrease in the hot water temperature θout, preferably, an amount of heat received Qr in the heat exchanger for hot water supply 140 is set to an amount of heat supplied Qs or less in the maximum heating capacity Gmax of the heating device. However, since the low-temperature water temperature θin is determined in the course of the process, it is not possible to reduce the temperature raising amount Δθ. Therefore, preferably, the hot water flow rate (the flow rate detection value qin) is limited so that an amount of heat received Qr in the heat exchanger for hot water supply 140 is equal to or less than an amount of heat supplied Qs in the maximum heating capacity Gmax of the heating device.

Here, the hot water flow rate (the flow rate detection value qin) can be limited by controlling a degree of opening of the flow rate regulating valve 170 deployed in the water inlet pipe 206. That is, the hot water flow rate can be limited by controlling a degree of opening of the flow rate regulating valve 170 so that a flow rate qin of water input to the water inlet pipe 206 is limited.

As shown in FIG. 4, when a limit flow rate of the hot water flow rate of the heating and hot water supply apparatus 100*a* according to the maximum heating capacity Gmax of the heating device is set to qgmax [L/min], the limit flow rate qgmax can be expressed as the following Formula (1). Here, in Formula (1), all of the amounts of heat of the heat transfer medium heated by the heating device are used for heating low temperature water in the heat exchanger for hot water supply 140.

$$qg\max = \frac{G\max \cdot 25}{\theta sv - \theta in} \cdot k \tag{1}$$

That is, the limit flow rate qgmax according to the maximum heating capacity Gmax of the heating device can be set on the basis of a value obtained by dividing the maximum heating capacity Gmax by the temperature raising amount Δθ (=θsv−θin) in the heat exchanger for hot water supply 140. Here, in Formula (1), a coefficient k is provided to prevent the limit flow rate qgmax from being estimated to be smaller than an actual value due to an error in an operation process in the CPU 111 of the controller 110. Therefore, a value of the coefficient k can be set to any positive number including k=1. The limit flow rate qgmax corresponds to an example of a "first limit flow rate."

According to Formula (1), when the target heating capacity (target number) of the heating device reaches the maximum heating capacity Gmax, a degree of opening of the flow rate regulating valve 170 is controlled so that the hot water flow rate (the flow rate detection value qin) does not exceed the limit flow rate qgmax. Therefore, since a decrease in the hot water temperature is reduced, hot water can be discharged according to the hot water supply set temperature θsv.

Here, while the temperature raising amount Δθ (=θsv−θin) in the heat exchanger for hot water supply 140 is constant, when the maximum heating capacity Gmax of the heating device is smaller, the limit flow rate qgmax is set to be a smaller value. That is, when the maximum heating capacity Gmax is lower, a limit of the hot water flow rate is stronger. Therefore, the heating and hot water supply apparatus 100*a* can match the hot water temperature θout with the hot water supply set temperature θsv regardless of a magnitude of the maximum heating capacity Gmax of the heating device.

However, on the other hand, in the heating and hot water supply apparatus 100*a*, when the low-temperature water temperature θin is high, regardless of the fact that e target heating capacity (target number) of the heating device does not reach the maximum heating capacity Gmax, a situation in which the output temperature θ1 of the heat transfer medium heated by the heat exchanger 130 is excessively high may occur.

For example, even if the temperature raising amount Δθ in the heat exchanger for hot water supply 140 is equal, when the low-temperature water temperature θin is high, the output temperature θ1 of the heat transfer medium in the heat exchanger 130 is likely to be higher than when the low-temperature water temperature θin is low. This is because, when the low-temperature water temperature θin is low, a temperature required for the temperature of the heat transfer medium introduced into the primary-side path 141 of the heat exchanger for hot water supply 140 (that is, the output temperature θ1 of the heat transfer medium heated by the heat exchanger 130) also decreases, and as a result, a temperature of the heat transfer medium output from the primary-side path 141 (that is, input temperature θ1in of the heat transfer medium in the heat exchanger 130) also decreases. In this manner, when the input temperature θ1in of the heat transfer medium in the heat exchanger 130 is low, even if the heating device is operated with a required heating capacity, there is a low possibility of the output temperature θ1 of the heat transfer medium becoming too high.

On the other hand, when the low-temperature water temperature θin is high, a temperature required for a temperature of the heat transfer medium introduced into the primary-side path 141 of the heat exchanger for hot water supply 140 (that is, the output temperature θ1 of the heat transfer medium heated by the heat exchanger 130) is also higher, and as a result, a temperature of the heat transfer medium output from the primary-side path 141 (that is, the input temperature θ1 in of the heat transfer medium in the heat exchanger 130) is also higher. In this manner, when the input temperature θ1in of the heat transfer medium in the heat exchanger 130 is high, if the heating device is operated with a required heating capacity, there is a high possibility of the output temperature θ1 of the heat transfer medium becoming too high.

Alternatively, even when the hot water supply set temperature θsv is constant, the output temperature θout of the heat transfer medium in the heat exchanger 130 is likely to be higher than when the low-temperature water temperature θin is low. This is because, when the low-temperature water temperature θin is higher, since an amount of heat received Qr in the heat exchanger for hot water supply 140 is smaller, the heat exchange efficiency in the heat exchanger for hot water supply 140 is low, and as a result, a temperature of the heat transfer medium output from the primary-side path 141 (that is, the input temperature θ1in of the heat transfer medium in the heat exchanger 130) is also higher.

Here, in the heating device, when the temperature of the heat transfer medium that flows through the heat transfer pipe of the heat exchanger 130 is too high, there is a risk of the heat transfer pipe being damaged due to overheating and a boiling sound being generated inside the heat transfer pipe. Therefore, in the heat exchanger 130, an upper limit temperature θ1max is set in advance for the output temperature θ1 of the heat transfer medium. Then, when the output temperature θ1 of the heat transfer medium reaches a high temperature that exceeds the upper limit temperature θ1max, an amount of heat generated in the combustion burner 120 is reduced in order to protect the heat exchanger 130. Here, reduction of an amount of heat generated in the combustion burner 120 also includes stopping of the combustion burner 120.

In this manner, when an amount of heat generated in the heating device is reduced, it is possible to reduce the occurrence of overheating and a boiling sound in the heat exchanger 130. However, on the other hand, an amount of heat supplied Qs in the heat exchanger for hot water supply 140 is reduced, and there is a concern of the hot water temperature θout being lowered. Here, when the heating capacity of the heating device in this case does not reach the maximum heating capacity Gmax, since there is no limitation on the hot water flow rate on the basis of the limit flow rate qgmax described above, it is difficult to reduce a decrease in the hot water temperature θout.

Therefore, in the heating and hot water supply apparatus 100*a* according to the present embodiment, in addition to the limit flow rate qgmax according to the maximum heating capacity Gmax of the heating device described above, on the basis of the heating capacity of the heating device in which the output temperature θ1 of the heat transfer medium reaches the upper limit temperature θ1max, a limit flow rate of the hot water flow rate (the flow rate detection value qin) is set.

Specifically, as shown in FIG. 5, when the limit flow rate of the hot water flow rate of the heating and hot water supply apparatus 100*a* according to the upper limit temperature θ1max of the heat transfer medium is set to qth1[L/min], the limit flow rate qth1 can be expressed as the following Formula (2). Here, in Formula (2), all of the amounts of heat of the heat transfer medium heated by the heating device are used for heating low temperature water in the heat exchanger for hot water supply 140, similarly to Formula (1).

$$qth1 = \frac{G1 \cdot 25}{\theta sv - \theta in} \cdot k \tag{2}$$

Here, in Formula (2), G1 is a heating capacity (number) when the output temperature θ1 of the heat transfer medium reaches the upper limit temperature θ1max if the heat transfer medium (input temperature θ1 in) introduced into the heat exchanger 130 is heated with a target heating capacity (target number) G1. The heating capacity G1 is given by the following Formula (3).

$$G1 = \frac{\theta 1\max - \theta 1\text{in}}{25} \cdot q1 \tag{3}$$

Here, q1 indicates a flow rate of the heat transfer medium that flows through the heat exchanger 130. Here, while a flow rate q1 of the heat transfer medium in the heat exchanger 130 cannot be directly measured, since the flow rate q1 during the hot water supply operation can be regarded as substantially constant, a preset constant is used in the present embodiment.

As clearly understood from Formula (3), the heating capacity G1 corresponds to a feed forward number required for the output temperature θ1 of the heat transfer medium to satisfy θ1≤θ1max. In other words, the output temperature θ1 of the heat transfer medium corresponds to an upper limit value of the heating capacity (number) at which the upper limit temperature θ1max is not exceeded.

Therefore, in Formula (2), using the heating capacity G1 as a feed forward number, the maximum flow rate of the hot water flow rate qin at which the output temperature θ1 of the heat transfer medium does not exceed the upper limit temperature θ1max is calculated and the calculated maximum flow rate is set as the limit flow rate qth1.

According to Formula (2), the limit flow rate qth1 by the upper limit temperature θ1max of the heat transfer medium can be set on the basis of a value obtained by dividing a multiplication value obtained by multiplying a temperature difference (=θ1max−θ1) between the upper limit temperature θ1max and the output temperature θ1 of the heat transfer medium by the flow rate q1 of the heat transfer medium that flows through the heat exchanger 130 by the temperature raising amount Δθ (=θsv−θin) in the heat exchanger for hot water supply 140. Here, in Formula (2), a coefficient k is provided to provide to prevent the limit flow rate qth1 from being estimated to be smaller than an actual value due to an error in an operation process in the CPU 111 of the controller 110. Therefore, a value of the coefficient k can be set to any positive number including 1. The limit flow rate qth1 corresponds to an example of a "second limit flow rate."

According to Formula (2), when the output temperature θ1 of the heat transfer medium during the hot water supply operation reaches the upper limit temperature θ1max, a target heating capacity of the heating device is set to G1 and a degree of opening of the flow rate regulating valve 170 is controlled so that the hot water flow rate does not exceed the limit flow rate qth1. Therefore, it is possible to discharge hot water according to the hot water supply set temperature θsv while the output temperature θ1 of the heat transfer medium is maintained at or below the upper limit temperature θ1max.

In addition, in the heating and hot water supply apparatus 100*a* according to the present embodiment, as shown in the following Formula (4), the smaller one between the limit flow rate qgmax according to the maximum heating capacity Gmax of the heating device and the limit flow rate qth1 according to the upper limit temperature θ1max of the heat transfer medium is set as a reference limit flow rate qff. Then, the flow rate regulating valve 170 is controlled so that the hot water flow rate does not exceed the reference limit flow rate qff.

$$qff = \text{Min}\{qg\ \max, qth1\} \tag{4}$$

Therefore, during the hot water supply operation, the smaller one between the limit flow rate qgmax and the limit flow rate qth1 is set as the reference limit flow rate qff, and feedforward control of the hot water flow rate is performed based on the reference limit flow rate qff. Accordingly, the hot water flow rate is limited before any one of a decrease in the hot water temperature θout due to the heating capacity of the heating device that reaches the maximum heating capacity Gmax and a decrease in the hot water temperature θout due to the output temperature θ1 of the heat transfer medium in the heating device that reaches the upper limit temperature θ1max occurs. Therefore, it is possible to control the flow rate regulating valve 170 so that as much hot water as possible is discharged while the upper limit temperature θ1max of the output temperature of the heat transfer medium is maintained and the hot water temperature θout is maintained at the hot water supply set temperature θsv.

Figure 6:
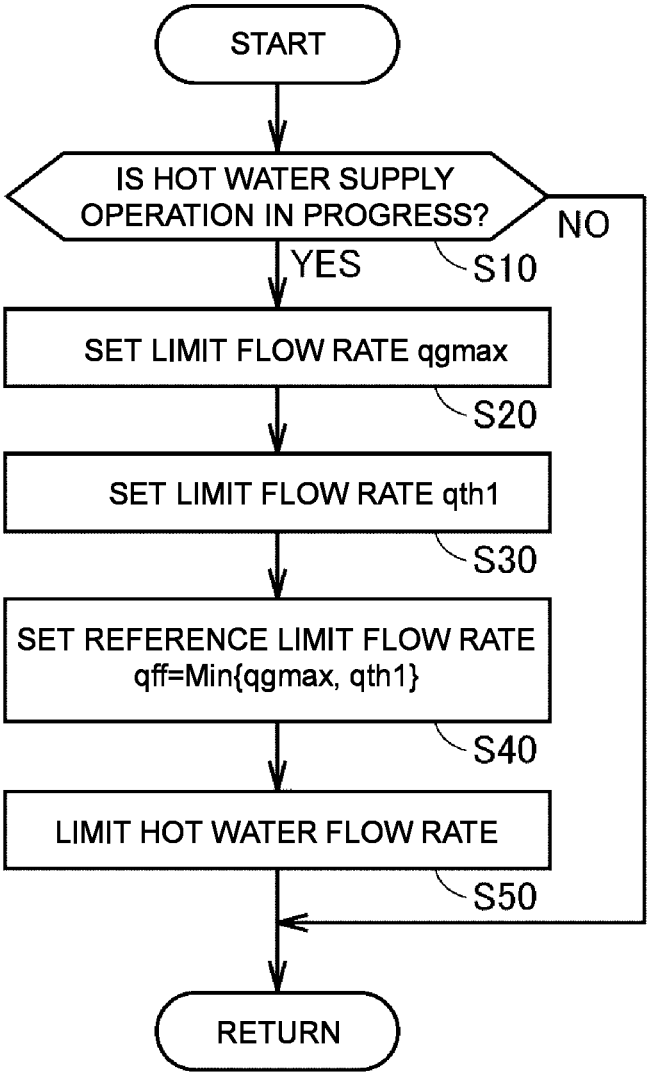
FIG. 6 is a flowchart for explaining a control process for limiting a hot water flow rate during a hot water supply operation in the heating and hot water supply apparatus according to Embodiment 1.

FIG. 6 is a flowchart explaining a control process for limiting a hot water flow rate when the hot water supply operation in the heating and hot water supply apparatus 100*a* according to Embodiment 1 is performed. The control process shown in FIG. 6 can be repeatedly performed by, for example, the CPU 111 of the controller 110, at predetermined control periods.

Referring to FIG. 6, the CPU 111 determines whether the heating and hot water supply apparatus 100*a* is in the hot water supply operation in Step S10. When the heating and hot water supply apparatus 100*a* is not in the hot water supply operation, NO is determined in Step S10, and the subsequent process is not performed.

When the hot water supply operation is in progress (when YES is determined in S10), the CPU 111 sets the limit flow rate qgmax (first limit flow rate) according to the maximum heating capacity Gmax of the heating device in Step S20, as shown in FIG. 4.

Next, in Step S30, as shown in FIG. 5, the CPU 111 sets the limit flow rate qth1 (second limit flow rate) according to the upper limit temperature θ1max of the heat transfer medium.

Next, in Step S40, the CPU 111 sets the smaller one between the limit flow rate qgmax according to the maximum heating capacity Gmax of the heating device set in Step S20 and the limit flow rate qth1 according to the upper limit temperature θ1max of the heat transfer medium set in Step S30 is set to the reference limit flow rate qff.

In Step S50, the CPU 111 controls the flow rate regulating valve 170 so that the hot water flow rate does not exceed the reference limit flow rate qff.

In this manner, according to the heating and hot water supply apparatus of the present Embodiment 1, the hot water flow rate is limited before any one of a decrease in the hot water temperature due to the heating capacity of the heating device that reaches the maximum heating capacity Gmax and a decrease in the hot water temperature according to the output temperature of the heat transfer medium in the heating device that reaches the upper limit temperature θ1max occurs. Therefore, it is possible to control the flow rate regulating valve 170 so that as much as hot water as possible is discharged while the upper limit temperature θ1max of the output temperature of the heat transfer medium is maintained and the hot water temperature is maintained at the hot water supply set temperature θsv.

Here, in Embodiment 1 described above, a configuration in which the limit flow rate qgmax according to the maximum heating capacity Gmax of the heating device is set, the limit flow rate qth1 according to the upper limit temperature θ1max of the heat transfer medium is set, and the smaller one between these two limit flow rates qgamx and qth1 is set as the reference limit flow rate qff has been described. However, as can be clearly understood when comparing Formula (1) and Formula (2), the above configuration is substantially the same in setting of the reference limit flow rate qff on the basis of the smaller one between the maximum heating capacity Gmax and the heating capacity G1 at which the output temperature θ1 of the heat transfer medium reaches the upper limit temperature θ1max. Therefore, even if a configuration in which the process of setting the limit flow rates qgamx and qth1 from the above configuration is omitted and the reference limit flow rate qff is set using the smaller one between the maximum heating capacity Gmax and the heating capacity G1 is used, it is possible to obtain the same operations and effects as in Embodiment 1.

In addition, while a configuration of limiting a hot water flow rate when only the hot water supply operation is performed has been described in Embodiment 1 described above, even during a simultaneous operation of the hot water supply operation and the heating operation, it is possible to limit a hot water flow rate using the same method as in Embodiment 1. However, during the simultaneous operation, as shown in FIG. 4, since the distribution ratio η1 of the distribution valve 150 is set to 0<η1<1, an amount of heat that is η1 times the amount of heat generated in the heating device is used to heat low temperature water in the primary-side path 141 of the heat exchanger for hot water supply 140. That is, the heating capacity of the heating device during the simultaneous operation is η1 times the heating capacity when only the hot water supply operation is performed. Therefore, the limit flow rate qff during the simultaneous operation may be η1 times limit flow rate qff when only the hot water supply operation is performed.

Embodiment 2

In Embodiment 1, a configuration example in which the smaller one between the limit flow rate qgmax according to the maximum heating capacity Gmax of the heating device and the limit flow rate qth1 according to the upper limit temperature θ1max of the heat transfer medium is set as the reference limit flow rate qff and the hot water flow rate is feedforward-controlled on the basis of the reference limit flow rate qff has been described.

However, in the above configuration example, even if the hot water flow rate is limited according to the reference limit flow rate qff, the hot water temperature θout may be below the hot water supply set temperature θsv. For example, when the temperature rise to 25° C. is not possible due to a detection error of the temperature sensor 253 configured to detect the low-temperature water temperature θin and the temperature sensor 251 configured to detect the input temperature θ1 in of the heat transfer medium in the heat exchanger 130 or due to a decrease in the heat exchange efficiency in the heat exchanger for hot water supply 140, even if the hot water flow rate is limited to the reference limit flow rate qff, the hot water temperature θout may not rise to the hot water supply set temperature θsv. In such a case, in order for the hot water temperature Clout to match the hot water supply set temperature θsv, it is necessary to further limit the hot water flow rate.

Thus, in Embodiment 2, a configuration for correcting the reference limit flow rate qff on the basis of a deviation of the hot water temperature θout (a temperature detected by the temperature sensor 255) with respect to the hot water supply set temperature θsv has been described. Here, since the overall configuration of the heating and hot water supply apparatus according to Embodiment 2 is the same as the heating and hot water supply apparatus 100*a* shown in FIG. 1, detailed descriptions thereof will not be repeated.

In the heating and hot water supply apparatus according to Embodiment 2, as in FIG. 2 to FIG. 6, transition of the operation state and setting of the reference limit flow rate qff are performed. In the heating and hot water supply apparatus according to Embodiment 2, additionally, the reference limit flow rate qff is corrected according to a deviation of the hot water temperature θout with respect to the hot water supply set temperature θsv. That is, the reference limit flow rate qff according to feedforward control is corrected so that control of the hot water flow rate according to feedback control is performed.

Specifically, the reference limit flow rate qff can be corrected using, for example, the following Formula (5).

$$qgs[n]=qff[n]\cdot(1-P_{FB}[n]) \tag{5}$$

Here, qgs indicates a reference limit flow rate reflecting a feedback element and $P_{FB}$ indicates a feedback adjustment amount. The reference limit flow rate qgs can be obtained by correction in which the reference limit flow rate qff is reduced according to feedforward control using the feedback adjustment amount $P_{FB}$.

The feedback adjustment amount $P_{FB}[n]$ at the time [n] is given by the next Formula (6). That is, the feedback adjustment amount $P_{FB}[n]$ is composed of two feedback elements $P_{\theta 2}[n]$ and $P_{\theta out}[n]$.

$$P_{FB}[n] = \frac{1}{Cr}\cdot\Sigma(P_{\theta 2}[n] + P_{\theta out}[n]) \tag{6}$$

$P_{\theta 2}[n]$ is a feedback element that is focused on the high-temperature water temperature θ2 of the output side of the secondary-side path 142 of the heat exchanger for hot water supply 140. $P_{\theta out}[n]$ is a feedback element that is focused on the hot water temperature θout. Here, in Formula (6), Cr is a constant having a dimension of time.

The feedback element $P_{\theta 2}[n]$ indicates a deviation of the high-temperature water temperature θ2 with respect to a target temperature θ2sv of the high-temperature water temperature θ2 and is expressed as the following Formula (7). Here, a denominator (θsv[n]−θin[n]) on the right side in Formula (7) is provided to induce a deviation as a ratio (dimensionless number).

$$P_{\theta 2} = \frac{\theta 2sv[n] - \theta 2[n]}{\theta sv[n] - \theta \mathrm{in}[n]} \tag{7}$$

Here, in Formula (7), the target temperature θ2sv can be calculated by the following Formula (8) on the basis of the distribution ratio η2 for hot water supply of the bypass flow rate valve 180 and the inlet water temperature θin.

$$\theta 2sv[n] = \frac{\theta sv[n] - \eta \mathrm{close} \cdot \theta \mathrm{in}[n]}{1 - \eta \mathrm{close}} \tag{8}$$

Formula (8) is obtained by arranging a relational expression (refer to Formula (9)) of the inlet water temperature θin, the high-temperature water temperature θ2, the distribution ratio η2 for hot water supply and the hot water temperature θout with respect to θ2. However, in Formula (8), θout=θsv (hot water supply set temperature) is set and η2 is set as a distribution ratio (η2=ηclose) for hot water supply when the bypass flow rate valve 180 is fully closed. When η2=ηclose is set, the entire amount of inlet water flows through the secondary-side path 142 of the heat exchanger for hot water supply 140. Therefore, the target temperature θ2sv is a value of the minimum high-temperature water temperature θ2 required for θout=θsv.

$$\theta \mathrm{out} = \eta \cdot \theta \mathrm{in} + (1 - \eta) \cdot \theta 2 \tag{9}$$

The feedback element $P_{\theta out}[n]$ indicates a deviation of the hot water temperature θout with respect to the hot water supply set temperature θsv and is expressed as the following Formula (10). Here, a denominator (θsv[n]−θin[n]) on the right side in Formula (10) is provided to induce a deviation as a ratio (dimensionless number).

$$P_{out} = \frac{\theta sv[n] - \theta \mathrm{out}[n]}{\theta sv[n] - \theta \mathrm{in}[n]} \tag{10}$$

Similarly to the feedback element $P_{\theta 2}[n]$, while the feedback element $P_{\theta out}[n]$ indicates a deviation of the temperature detected by the temperature sensor with respect to the target temperature, it is provided to finely regulate a limit flow rate when the hot water temperature θout does not match the hot water supply set temperature θsv even with the feedback element $P_{\theta 2}[n]$.

According to Formula (6), when two feedback elements $P_{\theta 2}[n]$ and $P_{\theta out}[n]$ are integrated, a correction amount (feedback adjustment amount $P_{FB}[n]$) of the reference limit flow rate qff is calculated. When a deviation of the hot water temperature θout with respect to the hot water supply set temperature θsv decreases, since a correction amount ($P_{FB}$[n]) of the reference limit flow rate qff also decreases, the reference limit flow rate qgs[n] is close to the reference limit flow rate qff [n].

In the heating and hot water supply apparatus according to the present embodiment, during the hot water supply operation, for each predetermined control period, the reference limit flow rate qgs reflecting a feedback element is set for the reference limit flow rate qff according to feedforward control. Accordingly, since it is possible to limit a hot water flow rate reflecting a deviation of the hot water temperature θout with respect to the hot water supply set temperature θsv, it is possible to stably discharge hot water according to the hot water supply set temperature θsv.

Figure 7:
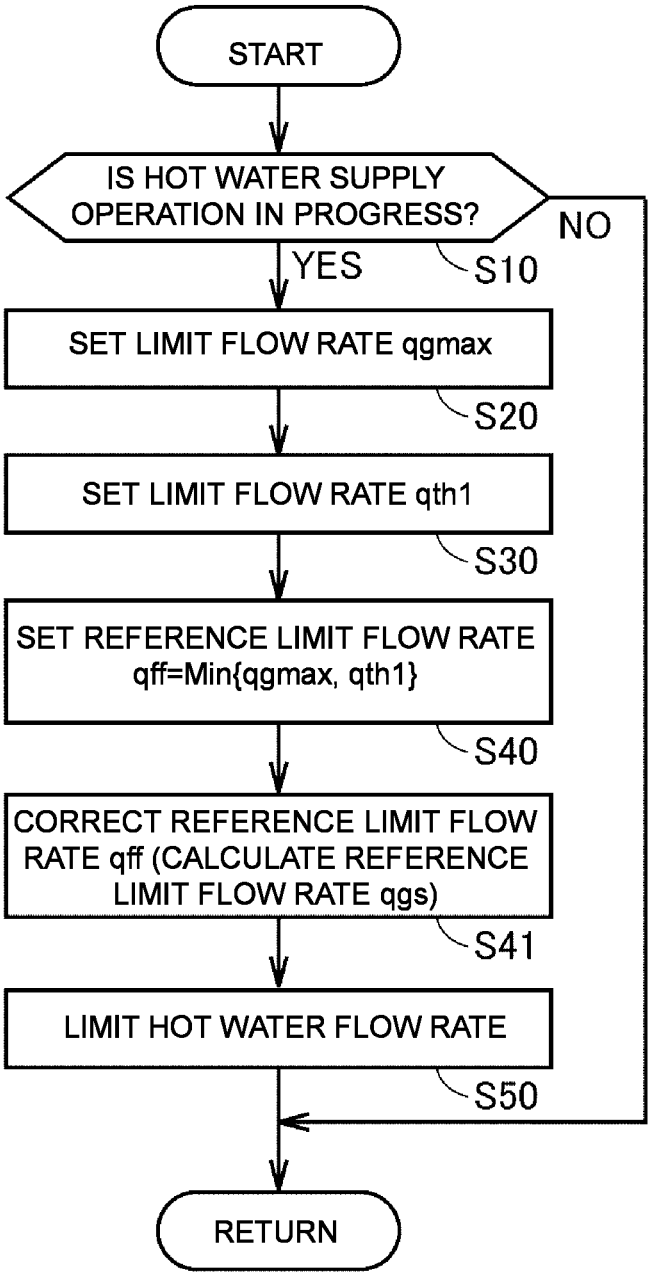
FIG. 7 is a flowchart for explaining a control process for limiting a hot water flow rate during a hot water supply operation in the heating and hot water supply apparatus according to Embodiment 2.

FIG. 7 is a flowchart for explaining a control process for limiting a hot water flow rate during a hot water supply operation in the heating and hot water supply apparatus according to Embodiment 2. The control process shown in FIG. 7 can be repeatedly performed by, for example, the CPU 111 of the controller 110, at predetermined control periods.

In FIG. 7, since processes with the same step numbers as in FIG. 6 are the same as those described in FIG. 6, detailed descriptions thereof will not be repeated. Processes that are different from the processes in FIG. 6 will be mainly described below.

Referring to FIG. 7, the CPU 111 sets the reference limit flow rate qff during the hot water supply operation by performing Steps S10 to S40, and advances the process to Step S41, and corrects the set reference limit flow rate qff. In Step S41, the CPU 111 calculates a reference limit flow rate qgs on the basis of a deviation of the high-temperature water temperature θ2 with respect to the target temperature θ2sv of the high temperature water temperature θ2 and a deviation of the hot water temperature θout with respect to the hot water supply set temperature θsv.

Next, the CPU 111 controls the flow rate regulating valve 170 so that the hot water flow rate does not exceed the corrected reference limit flow rate qff (=reference limit flow rate qgs) in Step S50.

In this manner, according to the heating and hot water supply apparatus of Embodiment 2, when the reference limit flow rate qff which is the smaller one between the limit flow rate qgmax according to the maximum heating capacity Gmax of the heating device and the limit flow rate qth1 according to the upper limit temperature θ1max of the heat transfer medium is corrected on the basis of a deviation of the hot water temperature θout with respect to the hot water supply set temperature θsv, it is possible to limit a hot water flow rate reflecting the deviation. Therefore, it is possible to stably discharge hot water according to the hot water supply set temperature θsv.

According to an aspect of the present disclosure, a heating and hot water supply apparatus includes a heating device configured to heat a heat transfer medium; a heating circulation path for circulating the heat transfer medium heated by the heating device when a heating operation is performed to and from the heating terminal; a heat exchanger for hot water supply including a primary-side path and a secondary-side path for heat exchange between liquids; a bypass path which branches from the heating circulation path and through which the heat transfer medium flows through the primary-side path of the heat exchanger for hot water supply without passing through the heating terminal when a hot water supply operation is performed and then joins the heating circulation path again; a water inlet pipe that is connected to an input side of the secondary-side path; a hot water delivery pipe that is connected to an output side of the secondary-side path; a flow rate regulating valve configured to control a hot water flow rate of the hot water delivery pipe; and a control unit configured to control the flow rate regulating valve so that the hot water flow rate does not exceed a reference limit flow rate when the hot water supply operation is performed. The reference limit flow rate is set on the basis of the smaller one between a maximum heating capacity of the heating device and a heating capacity of the heating device at which an output temperature of the heated heat transfer medium reaches an upper limit temperature.

According to the heating and hot water supply apparatus, when a reference limit flow rate is set on the basis of the smaller one between the maximum heating capacity of the heating device and a heating capacity of the heating device at which an output temperature of the heat transfer medium reaches an upper limit temperature, the hot water flow rate is limited before any of a case in which a heating capacity required for the heating device exceeds the maximum heating capacity and a case in which an output temperature of the heat transfer medium exceeds the upper limit temperature occurs, and thus it is possible to reduce a decrease in the hot water temperature. Therefore, it is possible to discharge as much hot water as possible according to a hot water supply set temperature while a heating device is protected.

According to an embodiment of the disclosure, when the output temperature of the heat transfer medium exceeds the upper limit temperature when the hot water supply operation is performed, the control unit additionally reduces an amount of heat generated in the heating device. Accordingly, while an amount of heat generated in the heating device is limited so that the output temperature of the heat transfer medium is maintained at or below the upper limit temperature, the hot water flow rate is limited so that the hot water supply set temperature is maintained. Therefore, it is possible to discharge as much hot water as possible according to a hot water supply set temperature while a heating device is protected.

According to an embodiment of the disclosure, when the hot water supply operation is performed, the control unit sets the smaller one between a first limit flow rate set on the basis of the maximum heating capacity of the heating device and a second limit flow rate set on the basis of a heating capacity of the heating device at which the output temperature of the heat transfer medium reaches the upper limit temperature as the reference limit flow rate, and controls the flow rate regulating valve so that the hot water flow rate does not exceed the reference limit flow rate.

Accordingly, since the reference limit flow rate can be set on the basis of the smaller one between the maximum heating capacity of the heating device and a heating capacity of the heating device at which an output temperature of the heat transfer medium reaches an upper limit temperature, the hot water flow rate is limited before any of a case in which a heating capacity required for the heating device exceeds the maximum heating capacity and a case in which an output temperature of the heat transfer medium exceeds the upper limit temperature occurs. Therefore, it is possible to discharge as much hot water as possible according to a hot water supply set temperature while a heating device is protected.

According to an embodiment of the disclosure, the heating and hot water supply apparatus further includes a first temperature sensor configured to detect an inlet water temperature of low temperature water introduced into the water inlet pipe; and a second temperature sensor configured to detect an input temperature of the heat transfer medium in the heating device. The first limit flow rate is set on the basis of the maximum heating capacity, a hot water supply set temperature in the hot water supply operation, and a temperature detected by the first temperature sensor. The second limit flow rate is set on the basis of an upper limit temperature of the heat transfer medium, a temperature detected by the second temperature sensor, a flow rate of the heat transfer medium that flows through the heating device, the hot water supply set temperature, and the temperature detected by the first temperature sensor.

Accordingly, it is possible to set a first limit flow rate at which it is possible to prevent a heating capacity required for the heating device from exceeding the maximum heating capacity and a second limit flow rate at which it is possible to prevent the output temperature of the heat transfer medium from exceeding the upper limit temperature.

According to an embodiment of the disclosure, the heating and hot water supply apparatus further includes a third temperature sensor configured to detect a hot water temperature of the hot water delivery pipe. The control unit corrects the reference limit flow rate on the basis of a deviation of a temperature detected by the third temperature sensor with respect to the hot water supply set temperature.

Accordingly, when the hot water temperature does not match the hot water supply set temperature even if the hot water flow rate is limited according to the reference limit flow rate, since the reference limit flow rate is corrected so that a deviation of the hot water temperature with respect to the hot water supply set temperature is eliminated, it is possible to realize stable discharge of hot water according to the hot water supply set temperature.

According to an embodiment of the disclosure, the control unit corrects the reference limit flow rate so that the reference limit flow rate decreases when the deviation of the temperature detected by the third temperature sensor with respect to the hot water supply set temperature increases. Accordingly, when the hot water temperature is below the hot water supply set temperature, since the reference limit flow rate is corrected (reduced) so that a deviation of the hot water temperature with respect to the hot water supply set temperature is eliminated, it is possible to realize stable discharge of hot water according to the hot water supply set temperature.

According to an embodiment of the disclosure, the heating and hot water supply apparatus further includes a bypass pipe which branches from the water inlet pipe and through which the low temperature water joins the hot water delivery pipe without passing through the secondary-side path; a bypass flow rate valve configured to control a flow rate ratio of the bypass pipe with respect to a flow rate of water input to the water inlet pipe; and a fourth temperature sensor configured to detect a temperature of high temperature water output from the secondary-side path to the hot water delivery pipe. The control unit calculates a target temperature of the high temperature water on the basis of a flow rate ratio in the bypass flow rate valve, a temperature detected by the first temperature sensor and the hot water supply set temperature. In addition, the control unit corrects the reference limit flow rate on the basis of a deviation of the temperature detected by the fourth temperature sensor with respect to the target temperature of the high temperature water and a deviation of the temperature detected by the third temperature sensor with respect to the hot water supply set temperature.

Therefore, since the reference limit flow rate is corrected so that a deviation of the high-temperature water temperature with respect to the target temperature of the high temperature water and a deviation of the hot water temperature with respect to the hot water supply set temperature are eliminated, it is possible to realize stable discharge of hot water according to the hot water supply set temperature.

According to another aspect of the present disclosure, there is provided a method of controlling a heating and hot water supply apparatus including a heating device configured to heat a heat transfer medium; a heating circulation path for circulating the heat transfer medium heated by the heating device when a heating operation is performed to and from the heating terminal; a heat exchanger for hot water supply including a primary-side path and a secondary-side path for heat exchange between liquids; a bypass path which branches from the heating circulation path and through which the heat transfer medium flows through the primary-side path of the heat exchanger for hot water supply without passing through the heating terminal and then joins the heating circulation path again; a water inlet pipe that is connected to an input side of the secondary-side path; a hot water delivery pipe that is connected to an output side of the secondary-side path; and a flow rate regulating valve configured to control a hot water flow rate of the hot water delivery pipe. The control method includes a step of setting a first limit flow rate on the basis of a maximum hot water supply capacity of the heating device; a step of setting a second limit flow rate on the basis of a heating capacity of the heating device at which an output temperature of the heated heat transfer medium reaches an upper limit temperature; and a step of setting the smaller one between the first limit flow rate and the second limit flow rate as a reference limit flow rate and controlling the flow rate regulating valve so that the hot water flow rate does not exceed the reference limit flow rate.

According to the method of controlling a heating and hot water supply apparatus, since a reference limit flow rate is set on the basis of the smaller one between the maximum heating capacity of the heating device and a heating capacity of the heating device at which an output temperature of the heat transfer medium reaches an upper limit temperature, the hot water flow rate is limited before any of a case in which a heating capacity required for the heating device exceeds the maximum heating capacity and a case in which an output temperature of the heat transfer medium exceeds the upper limit temperature occurs, and it is possible to reduce a decrease in the hot water temperature. Therefore, it is possible to discharge as much hot water as possible according to a hot water supply set temperature while a heating device is protected.

According to the present disclosure, during a hot water supply operation in a heating and hot water supply apparatus having a heating function and a hot water supply function, it is possible to discharge as much hot water as possible according to a hot water supply set temperature while a heating device is protected.

The embodiments disclosed here are only examples in all respects and should not be considered as restrictive. The scope of the present disclosure is defined not by the above description but by the scope of the claims, and is intended to encompass equivalents to the scope of the claims and all modifications within the scope.

What is claimed is:

1. A heating and hot water supply apparatus comprising:

a heating device configured to heat a heat transfer medium;

a heating circulation path for circulating the heat transfer medium heated by the heating device when a heating operation is performed to and from a heating terminal;

a heat exchanger for hot water supply including a primary-side path and a secondary-side path for heat exchange between liquids;

a bypass path which branches from the heating circulation path and through which the heat transfer medium flows through the primary-side path of the heat exchanger for hot water supply without passing through the heating terminal when a hot water supply operation is performed and then joins the heating circulation path again;

a water inlet pipe that is connected to an input side of the secondary-side path;

a hot water delivery pipe that is connected to an output side of the secondary-side path;

a flow rate regulating valve configured to control a hot water flow rate of the hot water delivery pipe; and a control unit configured to control the flow rate regulating valve so that the hot water flow rate does not exceed a reference limit flow rate when the hot water supply operation is performed, wherein the reference limit flow rate is set on the basis of the smaller one between a maximum heating capacity of the heating device and a heating capacity of the heating device at which an output temperature of the heated heat transfer medium reaches an upper limit temperature.

2. The heating and hot water supply apparatus according to claim 1, wherein, when the hot water supply operation is performed, the control unit additionally reduces an amount of heat generated in the heating device when the output temperature of the heat transfer medium exceeds the upper limit temperature.

3. The heating and hot water supply apparatus according to claim 1, wherein, when the hot water supply operation is performed, the control unit sets the smaller one between a first limit flow rate set on the basis of the maximum heating capacity of the heating device and a second limit flow rate set on the basis of a heating capacity of the heating device at which the output temperature of the heat transfer medium reaches the upper limit temperature as the reference limit flow rate, and controls the flow rate regulating valve so that the hot water flow rate does not exceed the reference limit flow rate.

4. The heating and hot water supply apparatus according to claim 2, wherein, when the hot water supply operation is performed, the control unit sets the smaller one between a first limit flow rate set on the basis of the maximum heating capacity of the heating device and a second limit flow rate set on the basis of a heating capacity of the heating device at which the output temperature of the heat transfer medium reaches the upper limit temperature as the reference limit flow rate, and controls the flow rate regulating valve so that the hot water flow rate does not exceed the reference limit flow rate.

5. The heating and hot water supply apparatus according to claim 3, further comprising a first temperature sensor configured to detect an inlet water temperature of low temperature water introduced into the water inlet pipe; and a second temperature sensor configured to detect an input temperature of the heat transfer medium in the heating device, wherein the first limit flow rate is set on the basis of the maximum heating capacity, a hot water supply set temperature in the hot water supply operation, and a temperature detected by the first temperature sensor, and wherein the second limit flow rate is set on the basis of the upper limit temperature of the heat transfer medium, a temperature detected by the second temperature sensor, a flow rate of the heat transfer medium that flows through the heating device, the hot water supply set temperature, and the temperature detected by the first temperature sensor.

6. The heating and hot water supply apparatus according to claim 4, further comprising a first temperature sensor configured to detect an inlet water temperature of low temperature water introduced into the water inlet pipe; and a second temperature sensor configured to detect an input temperature of the heat transfer medium in the heating device, wherein the first limit flow rate is set on the basis of the maximum heating capacity, a hot water supply set temperature in the hot water supply operation, and a temperature detected by the first temperature sensor, and wherein the second limit flow rate is set on the basis of the upper limit temperature of the heat transfer medium, a temperature detected by the second temperature sensor, a flow rate of the heat transfer medium that flows through the heating device, the hot water supply set temperature, and the temperature detected by the first temperature sensor.

7. The heating and hot water supply apparatus according to claim 5, further comprising a third temperature sensor configured to detect a hot water temperature of the hot water delivery pipe, wherein the control unit corrects the reference limit flow rate on the basis of a deviation of a temperature detected by the third temperature sensor with respect to the hot water supply set temperature.

8. The heating and hot water supply apparatus according to claim 6, further comprising a third temperature sensor configured to detect a hot water temperature of the hot water delivery pipe, wherein the control unit corrects the reference limit flow rate on the basis of a deviation of a temperature detected by the third temperature sensor with respect to the hot water supply set temperature.

9. The heating and hot water supply apparatus according to claim 7, wherein the control unit corrects the reference limit flow rate so that the reference limit flow rate decreases when the deviation of the temperature detected by the third temperature sensor with respect to the hot water supply set temperature increases.

10. The heating and hot water supply apparatus according to claim 8, wherein the control unit corrects the reference limit flow rate so that the reference limit flow rate decreases when the deviation of the temperature detected by the third temperature sensor with respect to the hot water supply set temperature increases.

11. The heating and hot water supply apparatus according to claim 7, further comprising a bypass pipe which branches from the water inlet pipe and through which the low temperature water joins the hot water delivery pipe without passing through the secondary-side path;

a bypass flow rate valve configured to control a flow rate ratio of the bypass pipe with respect to a flow rate of water input to the water inlet pipe; and a fourth temperature sensor configured to detect a temperature of high temperature water output from the secondary-side path to the hot water delivery pipe, wherein the control unit calculates a target temperature of the high temperature water on the basis of a flow rate ratio in the bypass flow rate valve, a temperature detected by the first temperature sensor and the hot water supply set temperature, and corrects the reference limit flow rate on the basis of a deviation of the temperature detected by the fourth temperature sensor with respect to the target temperature of the high temperature water and a deviation of the temperature detected by the third temperature sensor with respect to the hot water supply set temperature.

12. The heating and hot water supply apparatus according to claim 8, further comprising a bypass pipe which branches from the water inlet pipe and through which the low temperature water joins the hot water delivery pipe without passing through the secondary-side path;

a bypass flow rate valve configured to control a flow rate ratio of the bypass pipe with respect to a flow rate of water input to the water inlet pipe; and a fourth temperature sensor configured to detect a temperature of high temperature water output from the secondary-side path to the hot water delivery pipe, wherein the control unit calculates a target temperature of the high temperature water on the basis of a flow rate ratio in the bypass flow rate valve, a temperature detected by the first temperature sensor and the hot water supply set temperature, and corrects the reference limit flow rate on the basis of a deviation of the temperature detected by the fourth temperature sensor with respect to the target temperature of the high temperature water and a deviation of the temperature detected by the third temperature sensor with respect to the hot water supply set temperature.

13. The heating and hot water supply apparatus according to claim 9, further comprising a bypass pipe which branches from the water inlet pipe and through which the low temperature water joins the hot water delivery pipe without passing through the secondary-side path;

a bypass flow rate valve configured to control a flow rate ratio of the bypass pipe with respect to a flow rate of water input to the water inlet pipe; and a fourth temperature sensor configured to detect a temperature of high temperature water output from the secondary-side path to the hot water delivery pipe, wherein the control unit calculates a target temperature of the high temperature water on the basis of a flow rate ratio in the bypass flow rate valve, a temperature detected by the first temperature sensor and the hot water supply set temperature, and corrects the reference limit flow rate on the basis of a deviation of the temperature detected by the fourth temperature sensor with respect to the target temperature of the high temperature water and a deviation of the temperature detected by the third temperature sensor with respect to the hot water supply set temperature.

14. The heating and hot water supply apparatus according to claim 10, further comprising a bypass pipe which branches from the water inlet pipe and through which the low temperature water joins the hot water delivery pipe without passing through the secondary-side path;

a bypass flow rate valve configured to control a flow rate ratio of the bypass pipe with respect to a flow rate of water input to the water inlet pipe; and a fourth temperature sensor configured to detect a temperature of high temperature water output from the secondary-side path to the hot water delivery pipe, wherein the control unit calculates a target temperature of the high temperature water on the basis of a flow rate ratio in the bypass flow rate valve, a temperature detected by the first temperature sensor and the hot water supply set temperature, and corrects the reference limit flow rate on the basis of a deviation of the temperature detected by the fourth temperature sensor with respect to the target temperature of the high temperature water and a deviation of the temperature detected by the third temperature sensor with respect to the hot water supply set temperature.

* * * * *